US007003906B1

(12) United States Patent
Yang

(10) Patent No.: US 7,003,906 B1
(45) Date of Patent: Feb. 28, 2006

(54) VESSEL TO DISPLAY A CHANGEABLE ADVERTISEMENT

(76) Inventor: Hsiao-Chung Yang, No. 7-4, Lane 389, Liencheng Rd., Chungho City, Taipei Hsien (TW)

( * ) Notice: Subject to any disclaimer, the term of this patent is extended or adjusted under 35 U.S.C. 154(b) by 0 days.

(21) Appl. No.: 11/029,140

(22) Filed: Jan. 3, 2005

(51) Int. Cl.
*G09F 19/00* (2006.01)

(52) U.S. Cl. ..... 40/430; 40/455; 40/473; 362/811

(58) Field of Classification Search ..... 40/411, 40/414, 430, 427, 431, 473, 455, 906; 362/283, 362/284, 336, 811
See application file for complete search history.

(56) References Cited

U.S. PATENT DOCUMENTS 3,623,251 A * 11/1971 Bosch ..... 40/455
5,685,097 A * 11/1997 Marinov ..... 40/431
6,334,271 B1 * 1/2002 Su Yeh ..... 40/430
6,584,713 B1 * 7/2003 Huang ..... 40/431

* cited by examiner

*Primary Examiner*—Brian K. Green
(74) *Attorney, Agent, or Firm*—Dellett & Walters

(57) ABSTRACT

The vessel to display a changeable advertisement has a double walled vessel, an inside wall assembly, a windup motor, an upper wheel, a key and a bottom wheel. The inside wall is mounted rotatably in the double walled vessel. The windup motor is attached to the inside wall assembly. The upper wheel is attached to the double walled vessel and has a secondary gear and a threaded neck. The secondary gear is formed on the upper wheel. The key extends through the upper wheel, is attached to the windup motor and has a thread. The bottom wheel is mounted around the key and has a central threaded hole. When the central threaded hole screws onto the threaded neck on the upper wheel, the inside wall will rotate. When the central threaded hole screws onto the thread on the key, the double walled vessel will rotate.

8 Claims, 6 Drawing Sheets

VESSEL TO DISPLAY A CHANGEABLE ADVERTISEMENT

BACKGROUND OF THE INVENTION

1. Field of the Invention

The present invention relates to a vessel, especially to a vessel to display a changeable advertisement.

2. Description of the Prior Arts

Conventional vessels have patterns printed on outside surfaces to display an advertisement. However, the advertisements cannot be changed. Therefore, the versatility of the vessel is limited.

To overcome the shortcomings, the present invention provides a vessel to display a changeable advertisement to mitigate or obviate the aforementioned problems.

SUMMARY OF THE INVENTION

The main objective of the present invention is to provide a vessel to display a changeable advertisement. The vessel has a double walled vessel, an inside wall assembly, a windup motor, an upper wheel, a key and a bottom wheel. The double walled vessel has an inner vessel and an outer sidewall. The inside wall assembly has an inside wall and a base, and the inside wall is mounted rotatably between the inside vessel and outer sidewall of the double walled vessel. The windup motor is attached to the base of the inside wall assembly and has a rotating mechanism, a shaft and a main gear. The upper wheel is attached to outer sidewall of the double walled vessel and has a secondary gear and a threaded neck. The secondary gear is formed on the upper wheel and engages the main gear. The key extends through the upper wheel, is attached to the windup motor and has a thread. The bottom wheel is mounted around the key and has a central threaded hole. When the central threaded hole screws onto the threaded neck on the upper wheel, the inside wall assembly will rotate. When the central threaded hole screws onto the thread on the key, the double walled vessel will rotate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
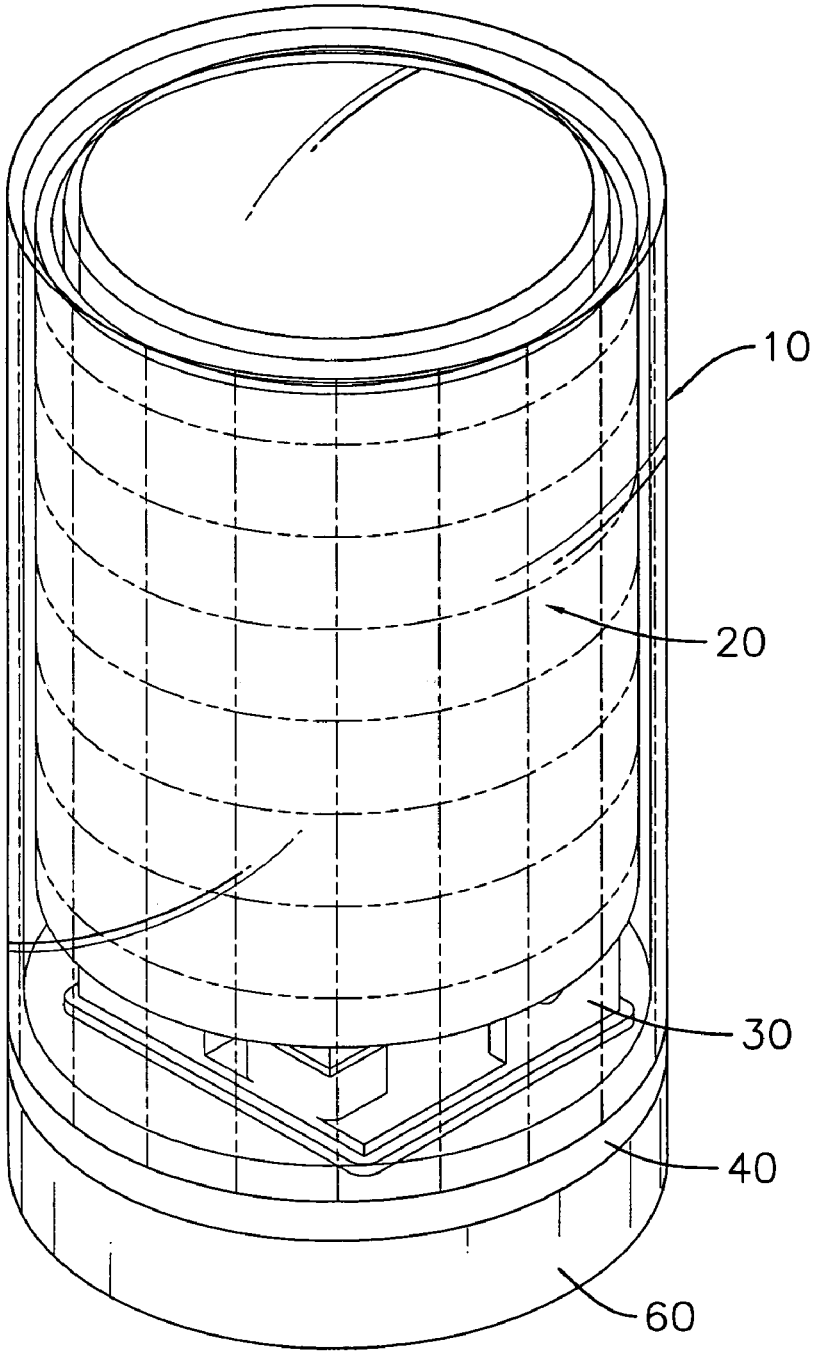
FIG. 1 is a perspective view of a vessel to display a changeable advertisement in accordance with the present invention.
Figure 2:
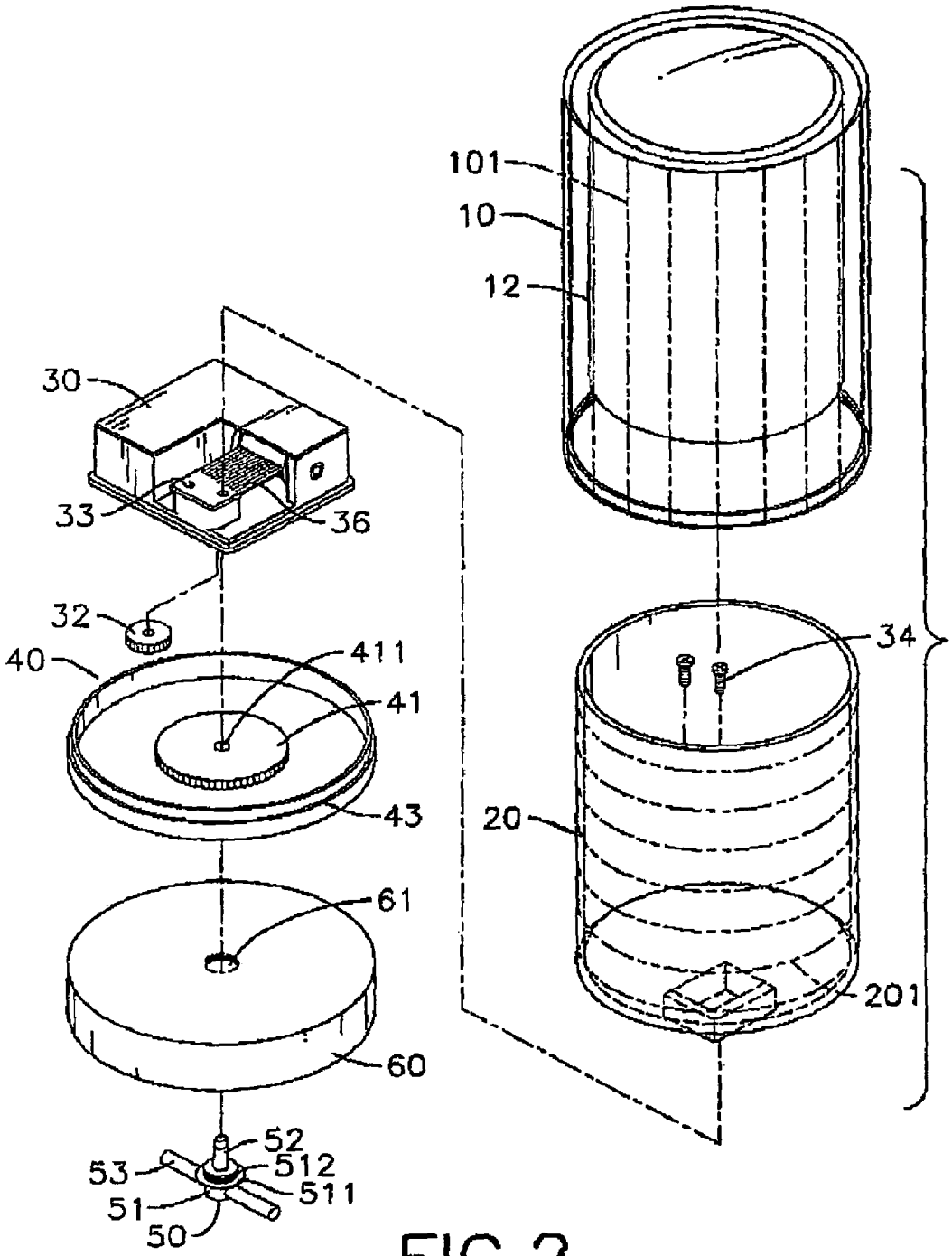
FIG. 2 is an exploded perspective view of the vessel in FIG. 1.

With reference to FIGS. 1 and 2, a vessel to display a changeable advertisement in accordance with the present invention comprises a double walled vessel (10), an inside wall assembly (20), a windup motor (30), an upper wheel (40), an key (50) and a bottom wheel (60).

Figure 3:
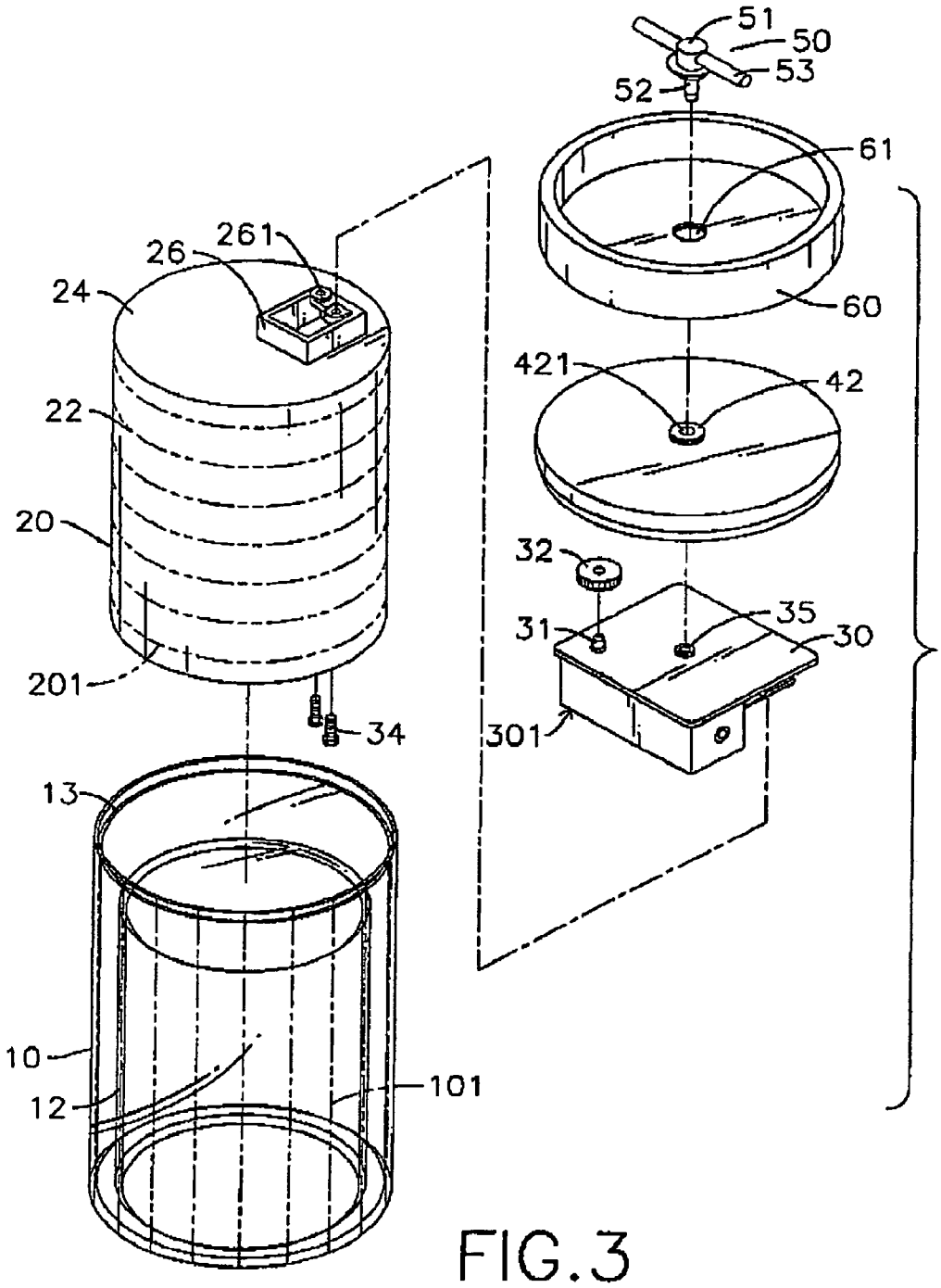
FIG. 3 is an exploded perspective upside down view of the vessel in FIG. 1.
Figure 4:
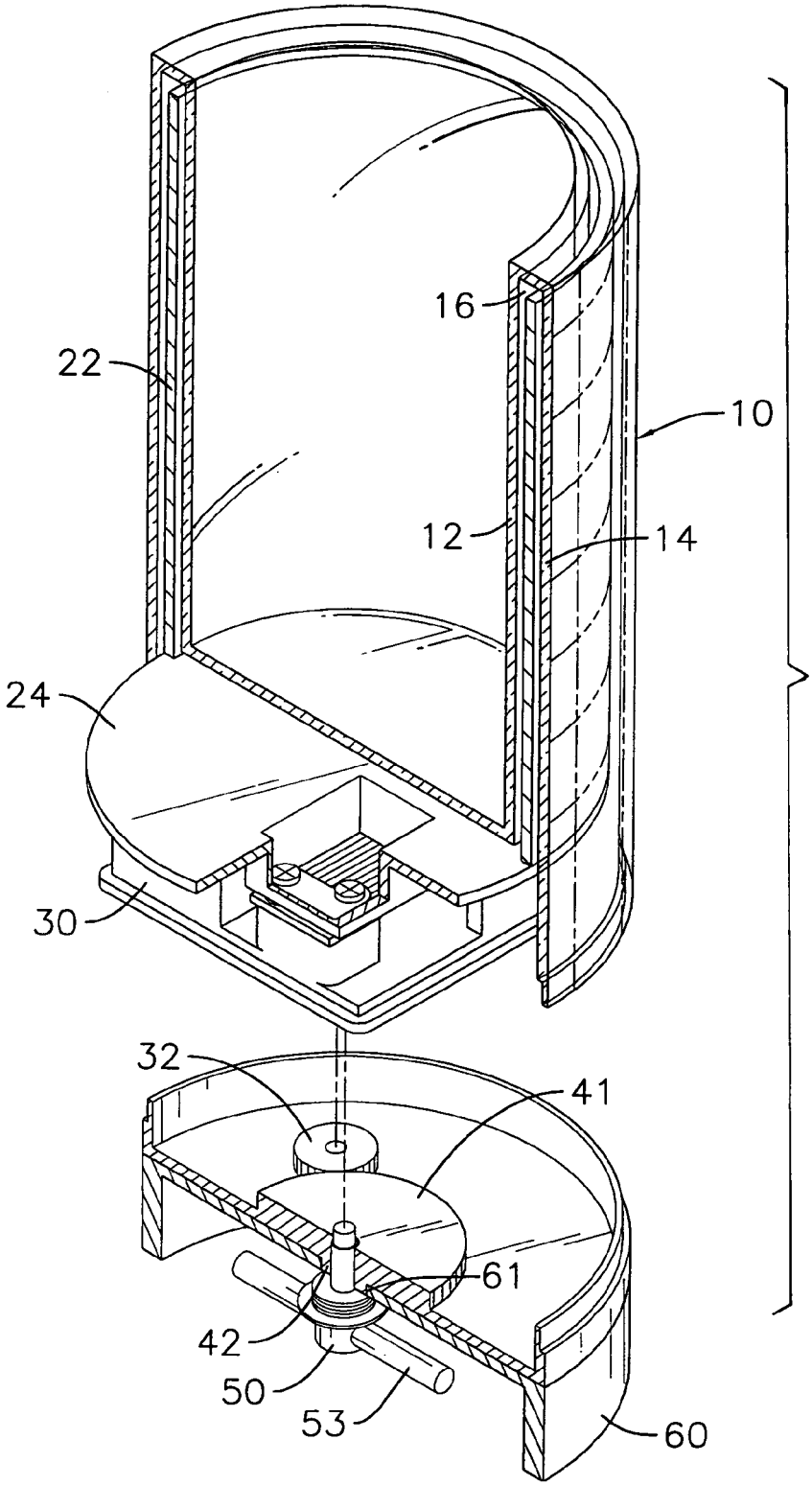
FIG. 4 is an exploded perspective view in partial section of the vessel in FIG. 1.

With further reference to FIGS. 3 and 4, the double walled vessel (10) is transparent, may have patterns (101) and has an inner vessel (12), an outer sidewall (14) and an inner gap (16). The inner vessel (12) has a top edge. The outer sidewall (14) has a top edge, a bottom edge and an optional shoulder (13). The top edge of the outer sidewall (14) is attached to the top edge of the inner vessel (12). The shoulder (13) is formed on the outer sidewall (14) near the bottom edge of the outer sidewall (14).

The inside wall assembly (20) is mounted rotatably in the inner gap (16) of the double walled vessel (10) and has patterns (201), a top, a bottom, an inside wall (22), a base (24) and a connector (26). The inside wall (22) has a top edge and a bottom edge. The base (24) is attached to the bottom edge of the inside wall (22) and has a bottom surface. The connector (26) is attached to the bottom surface of the base (24) and may have multiple fastening holes (261). The fastening holes (261) are formed through the connector (26).

The windup motor (30) is mounted on the inside wall assembly (20) and has a top, a bottom, a rotating mechanism (301), a shaft (31), a main gear (32), multiple optional fastening holes (33), multiple optional fasteners (34), a central hole (35) and an optional sound generator (36). The rotating mechanism (301) is mounted between the top and the bottom of the windup motor (30). The shaft (31) connects rotatably to and winds up the rotating mechanism (301) and protrudes from the bottom of the windup motor (30). The main gear (32) is mounted securely around the shaft (31). The fastening holes (33) are formed in the top of the windup motor (30) and correspond to the fastening holes (261) in the connector (26). The fasteners (34) extend through the through holes in the base (24) and the fastening holes (261) in the connector (26) and screw into the fastening holes (33) in the windup motor (30) to attach the windup motor (30) to the inside wall assembly (20). The central hole (35) is formed in the bottom of the windup motor (30). The sound generator (36) is mounted on the top of the windup motor (30) to generate sound.

The upper wheel (40) is recessed, is attached to the double walled vessel (10) and has a recessed top, a bottom, a central hole, a secondary gear (41), a threaded neck (42) and an optional flange (43). The secondary gear (41) is formed on the recessed top of the upper wheel (40), engages the main gear (32) and has a central hole (411). The threaded neck (42) is formed on the bottom of the upper wheel (40) and has a central hole (421). The flange (43) is formed around the upper wheel (40) and corresponds to and is attached to the shoulder (13) on the outer sidewall (14) of the double walled vessel (10) to attach the upper wheel (40) to the double walled vessel (10).

The key (50) connects to the upper wheel (40) and has a body (51), a longitudinal rod (52) and a transverse rod (53). The body (51) has a proximal end, a distal end, an outer surface, an annular flange (511) and a thread (512). The annular flange (511) is formed around and protrudes radially out from the body (51) near the proximal end. The thread (512) is formed on the outer surface of the body (51) adjacent to and above the annular flange (511). The longitudinal rod (52) is formed on and protrudes from the proximal end of the body (51), extends through the central holes (421, 411) in the threaded neck (42), the upper wheel (40) and the secondary gear (41) and screws into the central hole (35) in the windup motor (30). The transverse rod (52) extends through the body (51).

The bottom wheel (60) is recessed, is mounted around the key (50) and has a top, a recessed bottom and a central threaded hole (61). The central threaded hole (61) is formed through the bottom wheel (60) and is mounted around the longitudinal rod (52).

Figure 5:
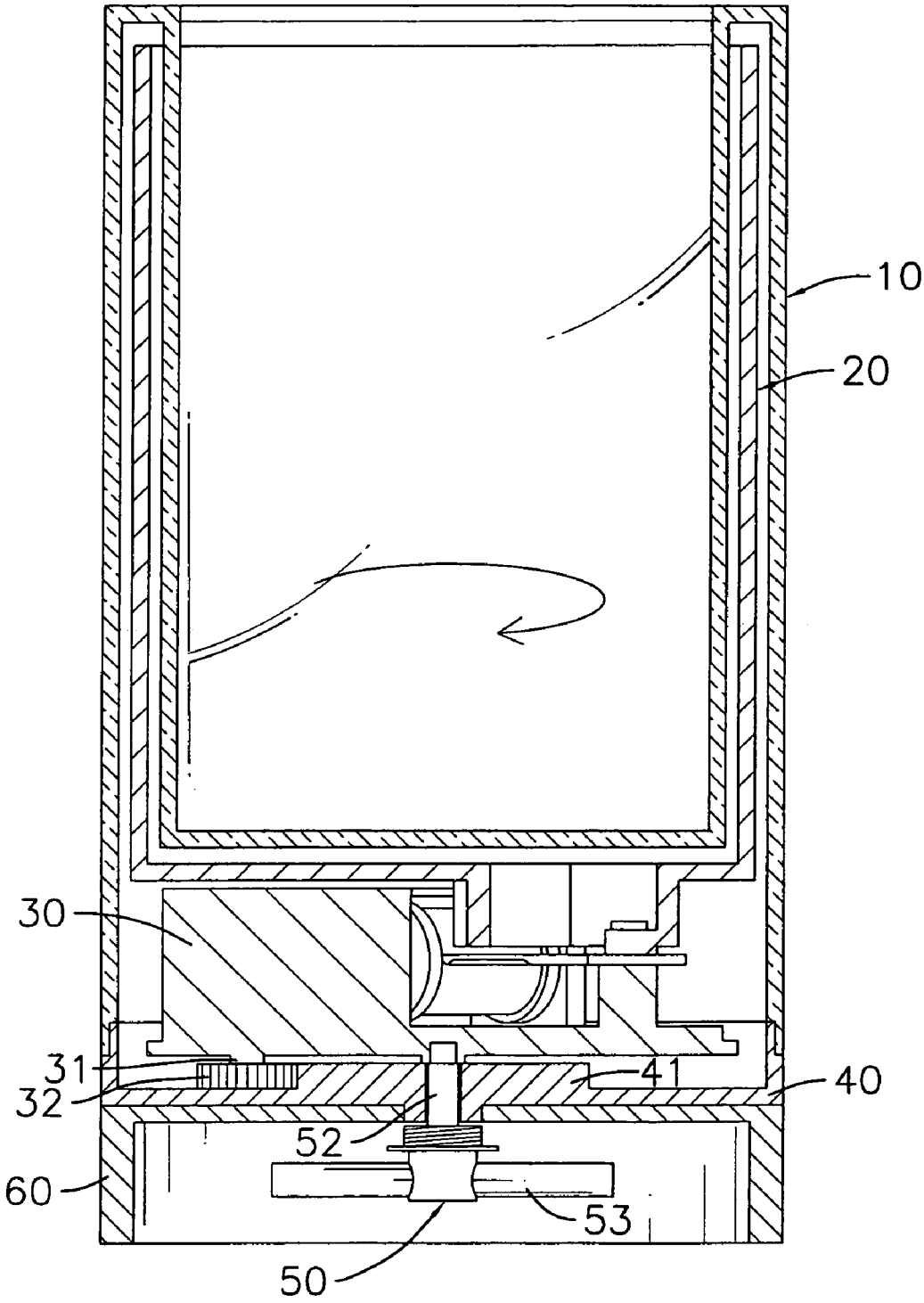
FIG. 5 is an operational front view in partial section of the vessel in FIG. 1 with the inside wall rotating.

With further reference to FIG. 5, the bottom wheel (60) is pushed upward to screw the central threaded hole (61) onto the threaded neck (42). The double walled vessel (10) and the upper wheel (40) are attached to the bottom wheel (60). When the key (50) is rotated, the windup motor (30) is rotated with the key (50). Because the shaft (31) will move with the windup motor (30), the main gear (32) will move with the shaft (31) and rotates along the periphery of the secondary gear (41). Consequently, shaft (31) is turned to windup the windup motor (30). When the transverse rod (53) is released, the inside wall (20) will be rotated with the energy provided by the windup motor (30).

Figure 6:
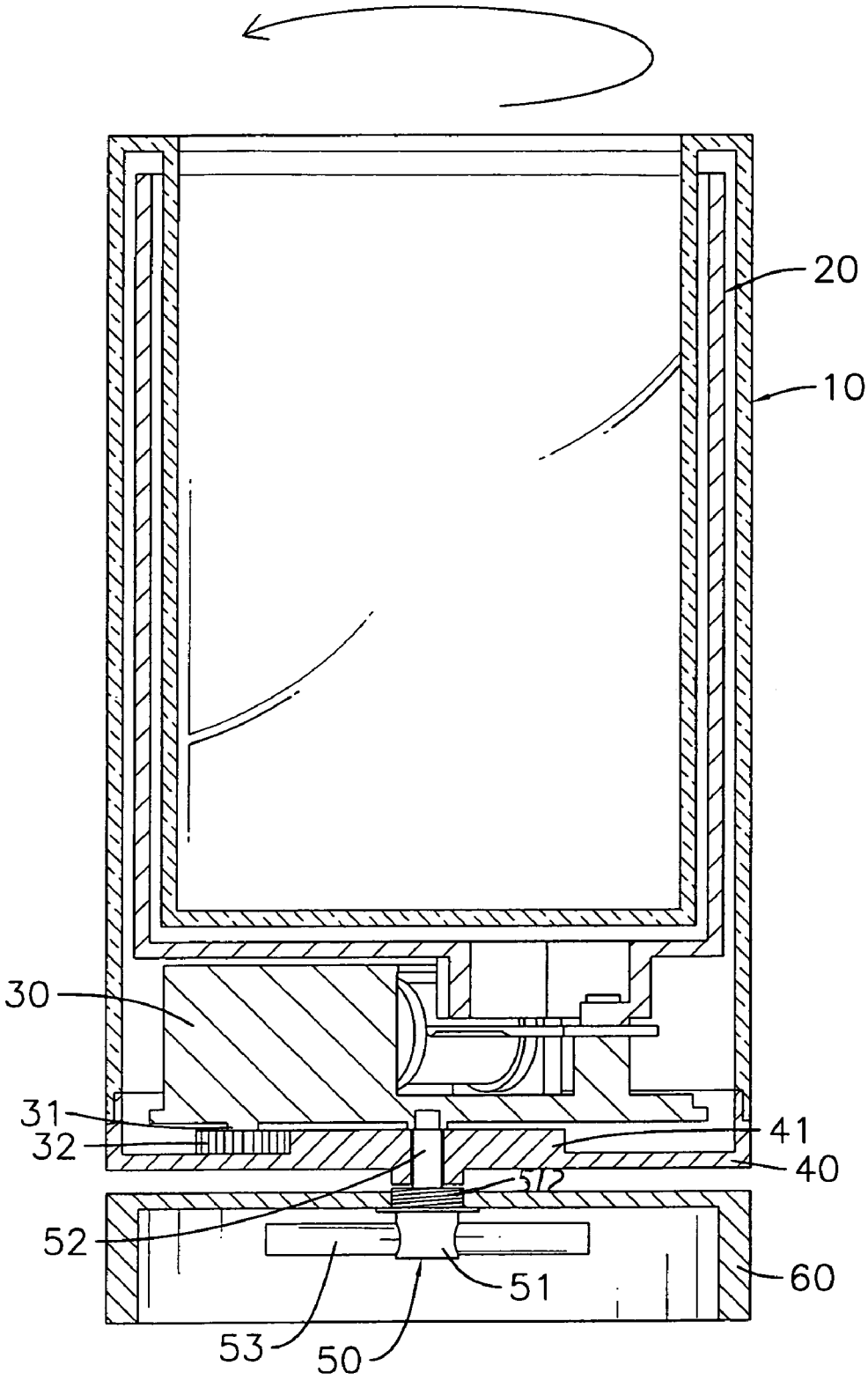
FIG. 6 is an operational front view in partial section of the vessel in FIG. 1 with the double walled vessel rotating.

With further reference to FIG. 6, the bottom wheel (60) is rotated to move downward along the threaded neck (42) to screw the central threaded hole (61) onto the thread (512) on the body (51) of the key (50). The key (50) and the windup motor (30) are attached to the bottom wheel (60). The double walled vessel (10) is turned to rotate the upper wheel (40). The secondary gear (41) on the upper wheel (40) is rotated to rotate the main gear (32), and the shaft (31) is rotated to wind the rotating mechanism (301) in the windup motor (30). When the double walled vessel (10) is released, the main gear (32) will be rotated with the energy provided by the rotating mechanism (301) in the windup motor (30) such that the double walled vessel (10) will be rotated with the transmission of the secondary gear (41).

Because the inside wall (22) has patterns (201) and the double walled vessel (10) is transparent, the patterns (201) will be more attractive no matter whether the inside wall (22) or the double walled vessel (10) is rotated. When the sound generator (36) on the windup motor (30) generates sound, the sound can correspond to the patterns (101, 201) to further enhance the advertisement.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A vessel to provide advertisement comprising:

a double walled vessel being transparent and having
- an inner vessel having a top edge
- an outer sidewall having
  - a top edge attached to the top edge of the inner vessel, and
  - a bottom edge, and
- an inner gap formed between the inner vessel and the outer sidewall, and the inner gap having a closed top and an open bottom;

an inside wall assembly mounted rotatably in the inner gap of the double walled vessel and having
- patterns,
- a top,
- a bottom,
- an inside wall having
  - a top edge, and
  - a bottom edge;
- a base attached to the bottom edge of the inside wall and having a bottom surface; and
- a connector attached to the bottom surface of the base;

a windup motor mounted on the inside wall assembly and having
- a top,
- a bottom,
- a rotating mechanism mounted between the top and the bottom of the windup motor,
- a shaft connecting rotatably to and winding up the rotating mechanism and protruding from the bottom of the windup motor,
- a main gear mounted securely around the shaft, and
- a central hole formed in the bottom of the windup motor;

an upper wheel being recessed, attached to the double walled vessel and having
- a recessed top,
- a bottom,
- a central hole,
- a secondary gear formed on the recessed top of the upper wheel, engaging the main gear and having a central hole, and
- a threaded neck formed on the bottom of the upper wheel and having a central hole;

a key connecting to the upper wheel and having
- a body having
  - a proximal end,
  - a distal end,
  - an outer surface,
  - an annular flange formed around and protruding out from the body near the proximal end, and
  - a thread formed on the outer surface of the body adjacent to and above the annular flange on the body;
- a longitudinal rod formed on and protruding from the proximal end of the body, extending through the central holes in the threaded neck, the upper wheel and the secondary gear and screwing into the central hole in the windup motor; and
- a transverse rod passing through the body; and a bottom wheel being recessed, mounted around the key and having
- a top,
- a recessed bottom, and
- a central threaded hole formed through the bottom wheel and mounted around the longitudinal rod of the key.

2. The vessel as claimed in claim 1, wherein the outer sidewall of the double walled vessel has a shoulder formed on the outer sidewall near the bottom edge of the outer sidewall; and the upper wheel has a flange formed around the upper wheel and corresponding to and attached to the shoulder on the outer sidewall of the double walled vessel to attach the upper wheel to the double walled vessel.

3. The vessel as claimed in claim 2, wherein the connector on the inside wall assembly has multiple fastening holes formed through the connector; and the windup motor has
- multiple fastening holes formed in the top of the windup motor and corresponding to the fastening holes in the connector; and
- multiple fasteners extending through the base and the fastening holes in the connector and screw into the fastening holes in the windup motor to attach the windup motor to the inside wall assembly.

4. The vessel as claimed in claim 3 wherein the double walled vessel has patterns.

5. The vessel as claimed in claim 4 wherein the windup motor has a sound generator to generate sound.

6. The vessel as claimed in claim 1, wherein the connector on the inside wall assembly has multiple fastening holes formed through the connector; and the windup motor has multiple fastening holes formed in the top of the windup motor and corresponding to the fastening holes in the connector; and multiple fasteners extending through the base and the fastening holes in the connector and screw into the fastening holes in the windup motor to attach the windup motor to the inside wall assembly.

7. The vessel as claimed in claim 1 wherein the double walled vessel has patterns.

8. The vessel as claimed in claim 1 wherein the windup motor has a sound generator to generate sound.

* * * * *